US006565413B2

(12) United States Patent
Brownrigg

(10) Patent No.: US 6,565,413 B2
(45) Date of Patent: May 20, 2003

(54) MODULAR HOUSE TOY

(76) Inventor: Sherri Brownrigg, 1951 Malcolm, #103, Los Angeles, CA (US) 90025

( * ) Notice: Subject to any disclaimer, the term of this patent is extended or adjusted under 35 U.S.C. 154(b) by 0 days.

(21) Appl. No.: 09/775,364

(22) Filed: Feb. 1, 2001

(65) Prior Publication Data

US 2001/0034183 A1 Oct. 25, 2001

Related U.S. Application Data

(60) Provisional application No. 60/182,062, filed on Feb. 11, 2000.

(51) Int. Cl.[7] ..... A63H 3/52
(52) U.S. Cl. ..... 446/476
(58) Field of Search ..... 446/476, 479, 446/482, 478, 369, 370

(56) References Cited

U.S. PATENT DOCUMENTS

| | | | | | |
|---|---|---|---|---|---|
| 4,030,235 | A | * | 6/1977 | Terzian et al. | 446/295 |
| 4,219,960 | A | * | 9/1980 | Walmer et al. | 446/110 |
| 4,233,778 | A | * | 11/1980 | Lemelson | 446/92 |
| 4,508,519 | A | * | 4/1985 | Becker | 446/478 |
| 4,722,712 | A | * | 2/1988 | McKenna | 446/476 |
| 4,911,670 | A | * | 3/1990 | McNicholas et al. | 446/487 |
| 4,978,301 | A | * | 12/1990 | Dodge | 446/112 |
| 4,992,068 | A | * | 2/1991 | Conrad | 446/478 |
| 5,004,445 | A | * | 4/1991 | Coleman et al. | 446/478 |
| 5,055,083 | A | * | 10/1991 | Walker et al. | 446/476 |
| 5,118,318 | A | * | 6/1992 | Lorizio | 446/901 |
| 5,435,769 | A | * | 7/1995 | Bertrand | 446/476 |
| 5,525,088 | A | * | 6/1996 | Mayne | 446/75 |
| 5,540,609 | A | * | 7/1996 | Hoag | 446/73 |
| 5,562,520 | A | * | 10/1996 | Pridonoff et al. | 446/478 |
| 5,707,269 | A | * | 1/1998 | Murphy | 446/75 |
| 5,947,786 | A | * | 9/1999 | Glick | 446/85 |
| 5,964,634 | A | * | 10/1999 | Chang | 446/111 |
| 6,065,253 | A | * | 5/2000 | Ojeda | 446/478 |

FOREIGN PATENT DOCUMENTS

| | | | | | |
|---|---|---|---|---|---|
| DE | 10000309 | A1 | * | 7/2001 | A63H/3/02 |
| EP | 718015 | A2 | * | 6/1996 | A63H/3/52 |
| EP | 1000645 | A2 | * | 5/2000 | A63H/3/52 |
| FR | 2644078 | A1 | * | 9/1990 | A63H/3/52 |

* cited by examiner

*Primary Examiner*—Derris H. Banks
*Assistant Examiner*—Urszula M Cegielnik

(57) ABSTRACT

A modular house toy comprising a plurality of stacked room modules in the form of open-sided boxes, including a triangular peak module and open deck modules, all comprising stiff wood panels that are covered with felt, and an array of felt-covered furnishing accessories having felt external surfaces to be positioned in the modules using the adhesive qualities of the felt. The accessories include flat felt cut-outs with printed designs for application to walls and floors in essentially two-dimensional form, and three dimensional furnishings that are covered with sewn or stitched felt and filled with stuffing such as batting or foam plastic, some being stiffened with paperboard. These belt accessories include not only chairs, beds, tables, a bathtub and the like, but also dolls simulating an entire family and domestic pets, the people having wire internal armatures of flexible wire. A lawn-simulating felt sheet and felt lawn accessories are provided for "outside" use, and some small three-dimensional accessories are provided in solid form, such as wood or plastic.

24 Claims, 6 Drawing Sheets

FIG. 8
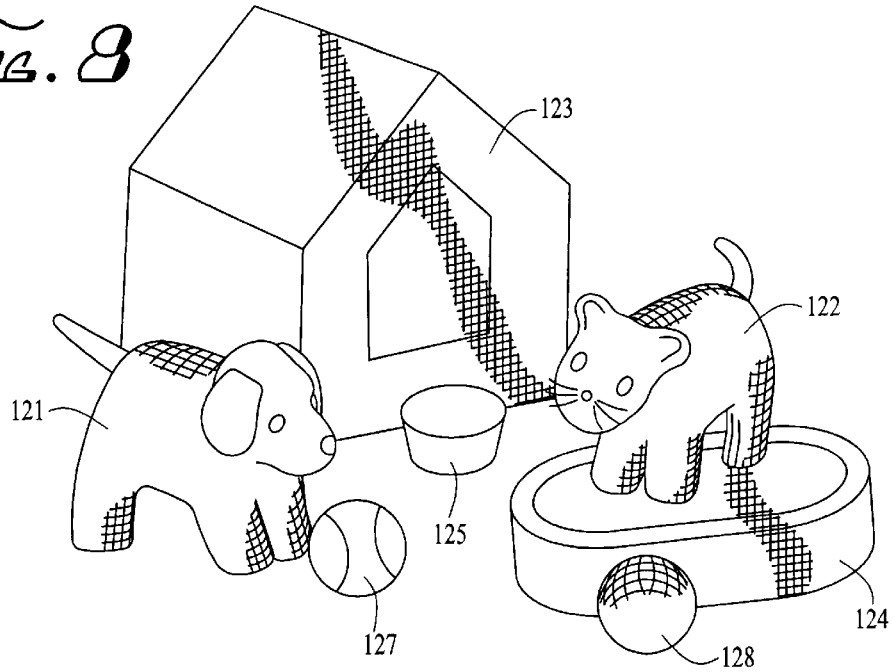
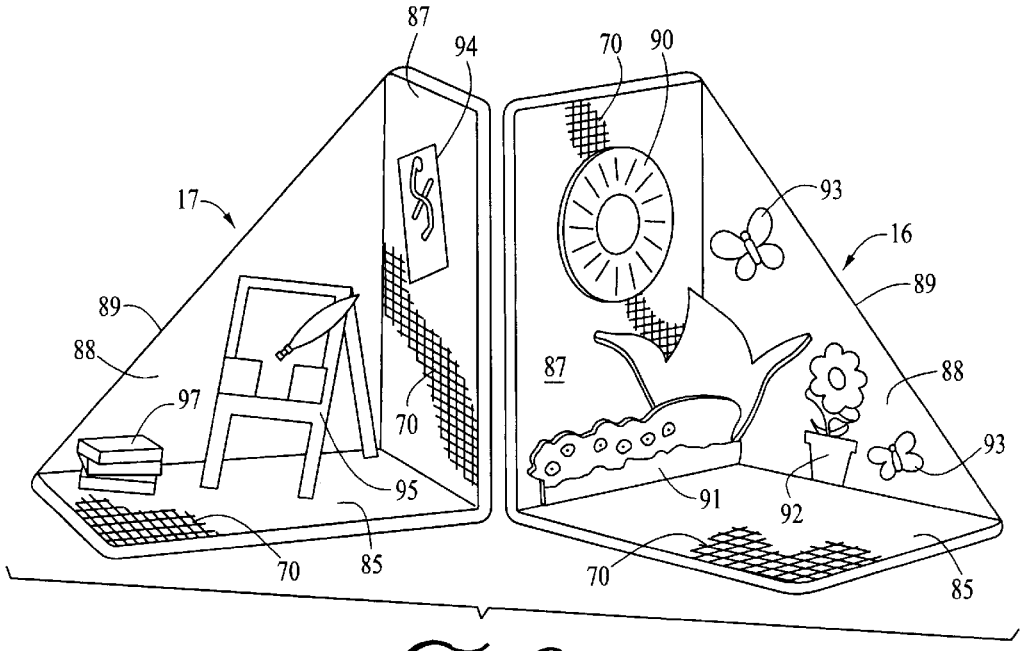
FIG. 9

FIG. 10
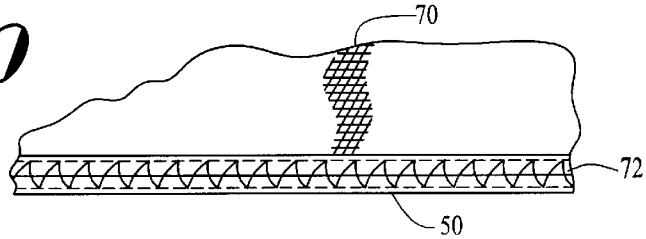
FIG. 11
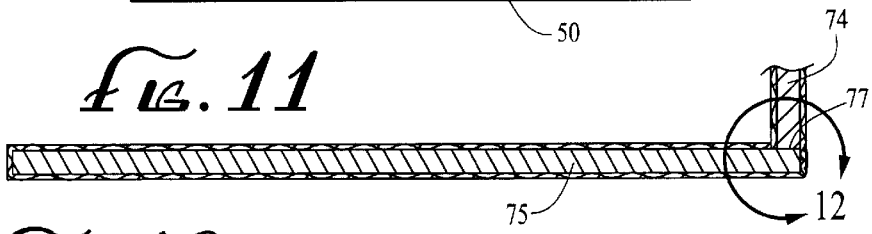
FIG. 12
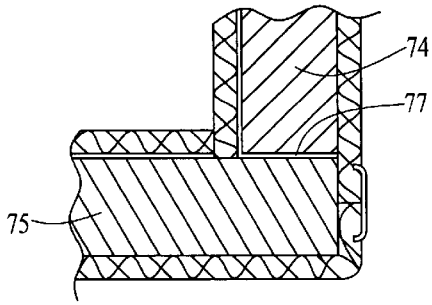
FIG. 13
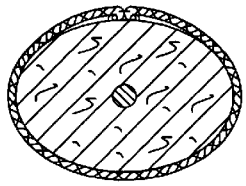
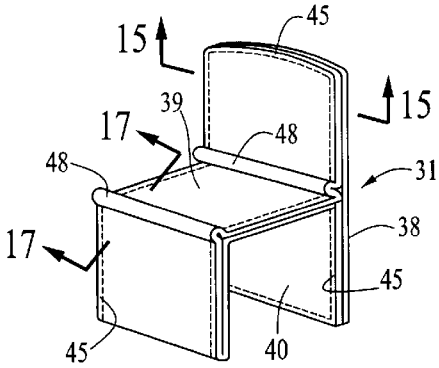
FIG. 15
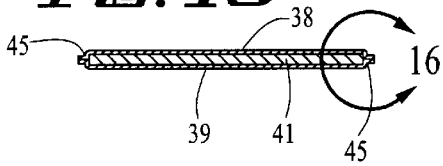
FIG. 14
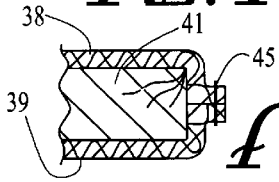
FIG. 16
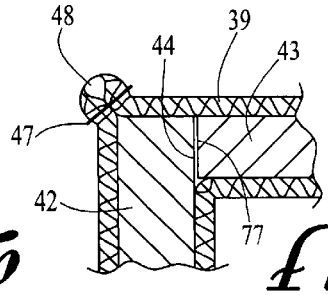
FIG. 17

MODULAR HOUSE TOY

CROSS REFERENCE TO PRIOR PROVISIONAL APPLICATION

This application claims the benefit of prior provisional application No. 60/182,062, filed Feb. 11, 2000.

FIELD OF THE INVENTION

The present invention relates to three-dimensional toys, and more particularly to three-dimensional toys that form a so-called doll house and accessories for furnishing the doll house.

DESCRIPTION OF PRIOR ART

It has long been common practice to provide miniature toy houses having internal partitions or walls dividing the interiors of the houses into a plurality of miniature rooms having floors, ceilings and upright walls, often with simulated windows, fixtures and other features of real homes, and with one entire side of the house being open to give the child access to the rooms for play purposes. Also commonly provided are miniature toy furnishings such as chairs, couches, beds, rugs, pictures and the like, which the child can place in the house and arrange in the rooms in positions that simulate realistic arrangements in full-sized houses. In addition, it has been known to provide dolls in the form of miniature people, and even cats, dogs and other domestic animals, to complete the interior of the toy house as if it were a real house occupied by a real family and all of their belongings.

SUMMARY OF THE INVENTION

The present invention provides a novel miniature house toy in which a plurality of flat-sided, box-like modules are shaped and sized to be stacked to simulate rooms in the structure of a toy house and have open sides that are arranged to form an open side of the toy house. The modules are made up of stiff, flat substrate panels that are shaped and joined together to form the walls, ceilings and floors of rooms of the house and have coverings of felt on their interior and exterior surfaces that not only decorate the modules but also serve to position the stacked modules relative to each other and to position felt-surfaced furnishing accessories and one or more felt-surfaced dolls in the house.

In the preferred embodiment of the invention shown herein, the modules are covered internally in multi-colored felt simulating the interior decoration of rooms, and externally in brightly colored felt giving the house toy an interesting and attractive appearance. The furnishing accessories and dolls are primarily composed of or covered with felt for a similarly colorful and attractive appearance and to provide felt surfaces for adhering to the felt of the modules to position the accessories and dolls in the modules.

The modules are constructed ruggedly and relatively inexpensively of stiff substrate panels such as particle board or plywood, adhesively secured together at the corners of the modules, and preferably are encased entirely in felt sheet material that is cut to match the size of the surfaces to be covered, adhesively secured to the panels for lasting tightness and durability, and suitably joined around the edges and corners, for example by sewing where two free edges meet and by an integral fold where two sheets of the same color meet.

In addition to conventional interior rooms having rectangular open sides for access, the invention provides a triangular attic room that can be the peak of a house, triangular deck rooms having more than one open side, and a "lawn" piece for simulating the outside area of a house.

Furnishing accessories may take various forms, from simple felt cut-outs printed with decorations simulating pictures, windows, cabinets, appliances and carpets or rugs, to more complex forms such as felt-covered furniture—chairs, beds, stools, tables—with internal stiffening that may be paper of cardboard, or a stiffer substrate. Similarly, the dolls, which preferably simulate an entire miniature family, have felt exterior coverings that are filled with stuffing material such as batting, and may have wire internal armatures providing a desirable amount of firm flexibility. The family can include pets, with appropriate pet furnishings as well, and felt furnishings also are provided for the lawn area.

The result is a novel and very attractive miniature house toy that uses felt coverings to produce attractive, colorful and durable room modules and accessories for the house and also utilizes the adhering qualities of the felt to position and maintain the components in selected positions. Accordingly, the novel house toy of the invention has a very high "play" value.

Other aspects and advantages of the invention will become apparent from the following detailed description taken in conjunction with the accompanying drawings.

BRIEF DESCRIPTION OF THE DRAWINGS

FIG. 8 is an enlarged perspective view of two dolls simulating domestic pets shown in FIG. 1, together with several pet furnishing accessories, also shown in moved positions;

FIG. 9 is an enlarged perspective view of two triangular deck space modules shown in FIG. 1, together with several deck furnishing accessories, also shown in moved positions;

FIG. 10 is an enlarged fragmentary perspective view taken substantially within the area indicated by the arrow 10 in FIG. 4;

FIG. 11 is an enlarged fragmentary cross-sectional view taken along line 11—11 of FIG. 4;

FIG. 12 is an enlarged fragmentary cross-sectional view taken substantially within the circle indicated by the arrow 12 in FIG. 11;

FIG. 13 is an enlarged cross-sectional view taken along the line 13—13 in FIG. 6;

FIG. 14 is an enlarged fragmentary perspective view of a chair shown in FIG. 1;

FIG. 15 is an enlarged cross-sectional view taken along the line 15—15 of FIG. 14;

FIG. 16 is an enlarged fragmentary cross-sectional view taken substantially within the circle indicated by the arrow 16 in FIG. 15; and FIG. 17 is an enlarged fragmentary cross-sectional view taken along line 17—17 of FIG. 14.

DETAILED DESCRIPTION OF THE PREFERRED EMBODIMENT

Figure 1:
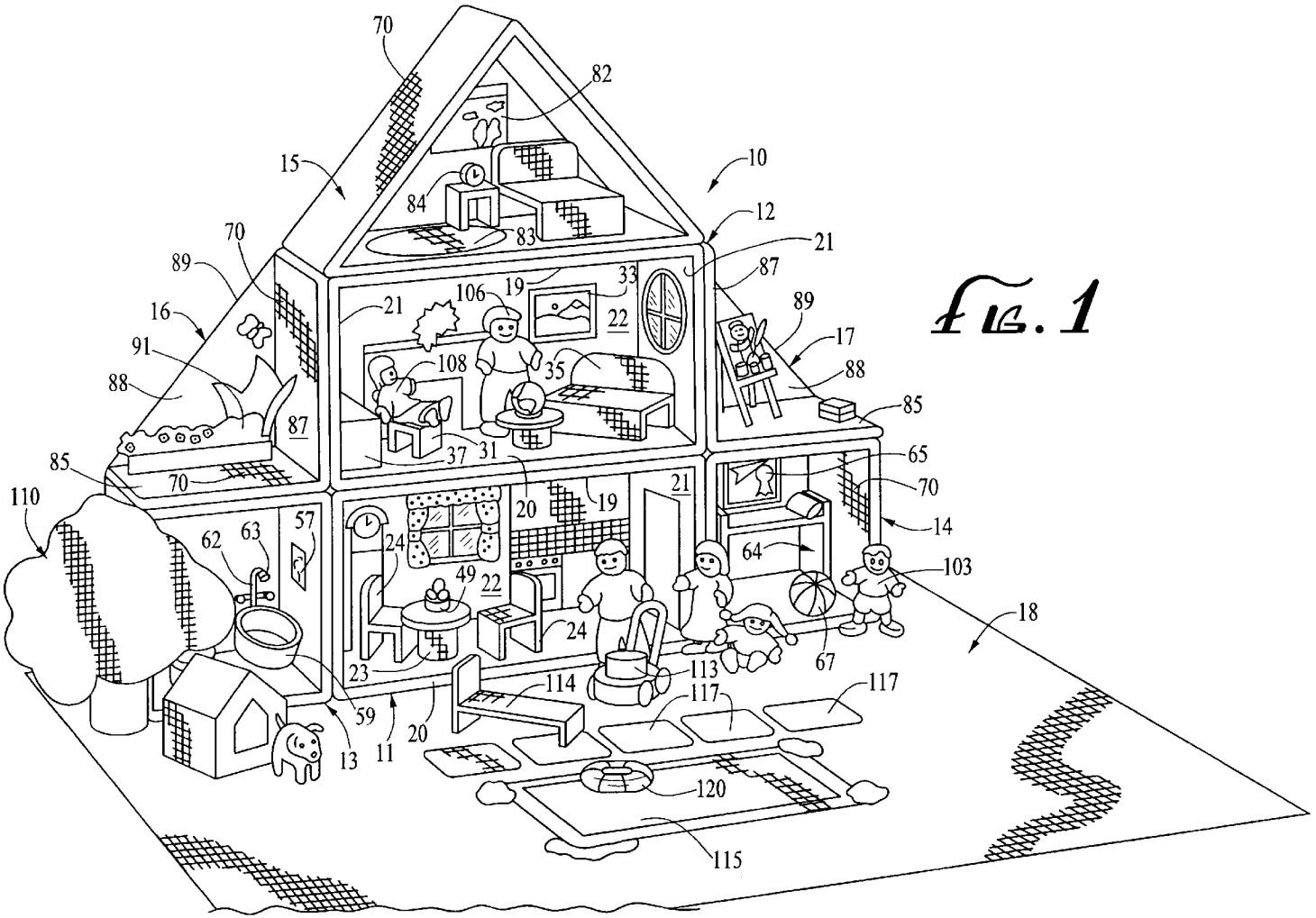
FIG. 1 is a front perspective view of a preferred embodiment of a three-dimensional house toy according to the invention, comprising a plurality of room modules stacked together to form an entire house structure and including various furnishing accessories, dolls, a lawn piece and other decorations in accordance with the invention.

As shown in the drawings for purposes of illustration, the invention is embodied in a miniature house toy, indicated generally by the arrow 10 in FIG. 1, that is made up of a plurality of room-simulating modules indicated generally as 11, 12, 13, 14, 15, 16 and 17 that are stacked together to form a miniature house in FIG. 1, and are furnished with a variety of furnishing accessories and dolls simulating people and pets for inhabiting the house, to be described in more detail. Also included in the preferred embodiment is a lawn or backyard-simulating piece 18, with several miniature lawn accessories to be described.

Such a house toy may be sold as a single collection including the components shown in FIG. 1, or separate kits of only parts of the full collection may be provided as separate toys, to be collected and added to, from time to time. Such a kit might be only a single room module and its furnishings, as shown in FIG. 3, or a "starter house" of two modules 12 and 15, as shown in FIG. 2.

In accordance with the present invention, each of the modules 11 to 17 of the modular house toy 10 is composed of a rigid substrate that is capable of providing structural support for the toy house, and the substrate is covered with multi-colored felt sheet material that not only decorates the structures but also serves to position the modules and the various accessory pieces and dolls in different selected positions chosen by the user, typically a child. For this purpose, the accessory pieces also have multi-colored felt exterior surfaces that both decorate the accessories and the dolls and also cooperate with the felt coverings of the modules to position the accessories and the dolls in different positions throughout the miniature house. The result is a novel and highly attractive house toy with a high level of "play" capability.

With specific reference to FIG. 1, the modules 11 to 17 of the illustrative house toy comprise two larger, elongated room modules 11 and 12 in the center of the stacked arrangement, the module 11 being decorated as a kitchen-simulating module resting on a supporting surface as the lowest level of the house and the module 12 being decorated as a living room module and stacked on top of the kitchen module, as a second-floor room. These two modules may be identical in construction, having elongated horizontal top and bottom walls 19 and 20, shorter upright end walls 21 scaled to simulate a standard eight-foot room height, and an elongated upright back wall 22, which can be regarded as forming part of the front side of the miniature house.

Figure 2:
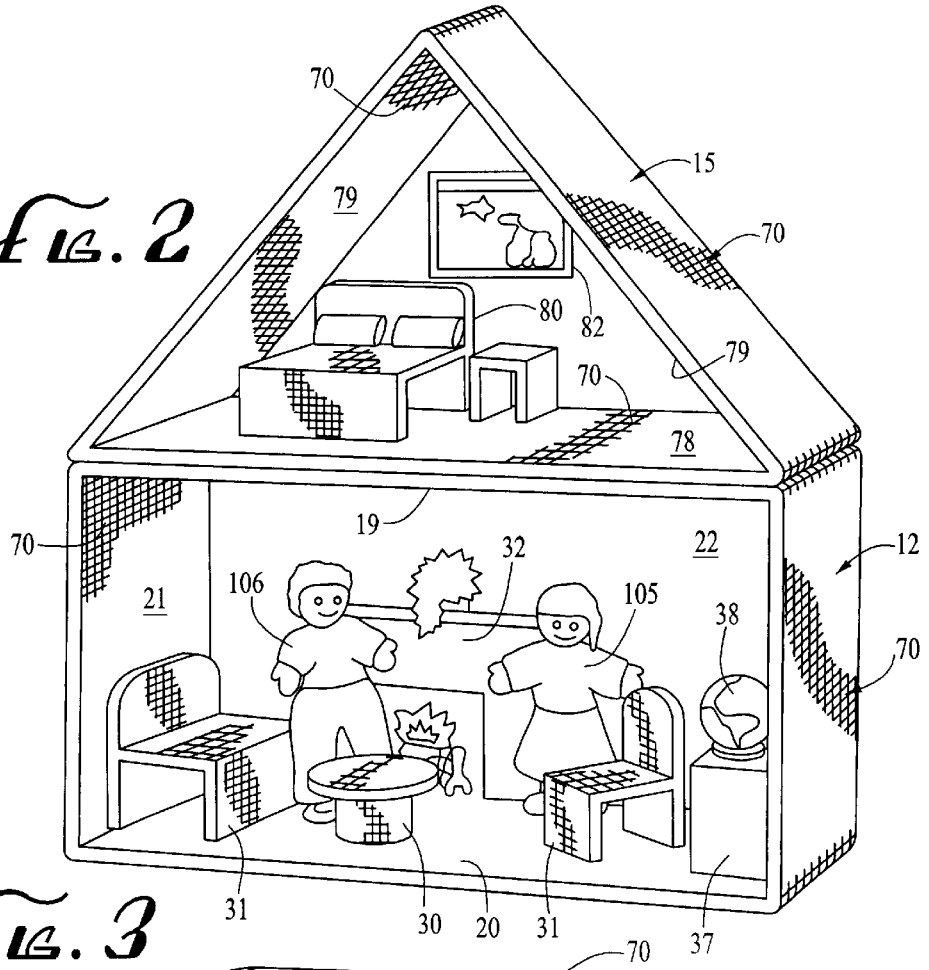
FIG. 2 is an enlarged front perspective view of an alternative house structure according to the present invention, made up of two room modules and other components shown in FIG. 1, in moved positions, simulating a starter house.
Figure 3:
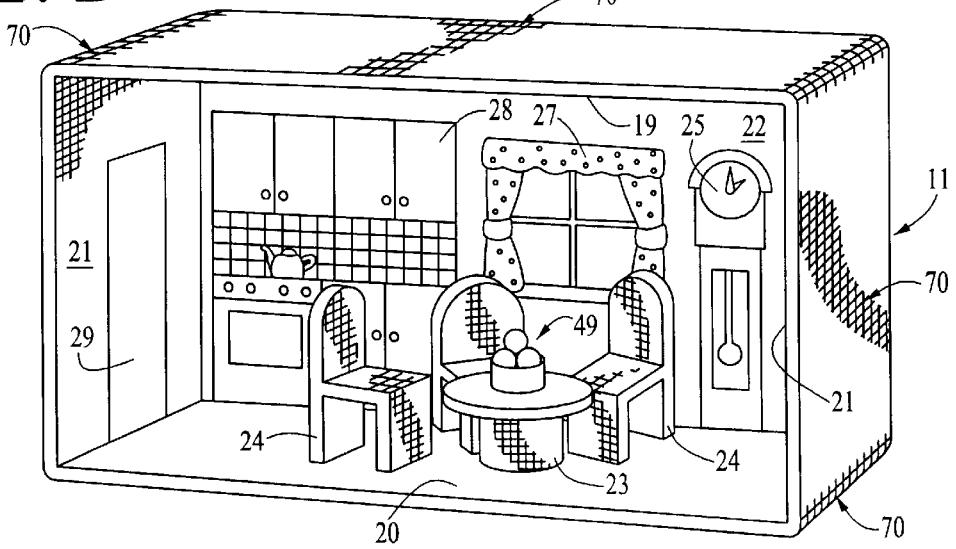
FIG. 3 is an enlarged front perspective view of a single room module shown in FIG. 1 and simulating a kitchen, also with parts in moved positions.

These two modules, which can be of substantially the same structure, also are shown in FIGS. 1 and 2, with substantially the same furnishings but re-arranged, as a child at play might re-arrange these rooms. The furnishing accessories include a kitchen table 23 and chairs 24; a clock 25, a window 27, and a stove/cabinet appliance 28 on one wall 22; and a door 29, all in the kitchen; and a table 30 and chairs 31; a fireplace 32, a window 33 and a picture 34 on the walls (FIG. 1); a couch 35; and a cabinet 37, with a globe accessory 38 in FIG. 2. The accessories on the walls are flat pieces of felt that are cut to the desired outside shape and printed with the design features that simulate the respective furnishing. These essentially two-dimensional felt pieces will adhere to the felt-covered surfaces of the room modules 11 and 12, and thus will be positioned in the modules in selected positions that can be changed by the child as desired, in "redecorating" the miniature house.

Similarly, the primary three-dimensional furnishings, such as the chairs, the couch and the tables, are made of felt and reinforced as necessary or desirable to impart structural strength or relative rigidity. The chair 31, for example, is shown in detail in FIGS. 14 to 17 as comprising three strips 38, 39, and 40 of felt that are applied to internal structural substrates 41, 42 and 43 (FIGS. 15–17), which may be paperboard sheets, or other relatively stiff material, that are glued together at their junctures, as shown at 44 in FIG. 17. The felt strips cover the substrate and preferably are adhesively secured thereto by a suitable glue, and also are stitched at 45 around the edges of the substrate and at 47 to form loop-like ribs 48 at the junctures of the substrate. Formed in this fashion, the chair has colorful felt surfaces for an attractive and somewhat realistic appearance, and also for positioning engagement with other components of the miniature house toy. The same construction technique, which is quite inexpensive using modern mass-production machinery, can be used for the other furniture-simulating and three-dimensional pieces.

In some instances, particularly for small accessory items such as the centerpiece 49 on the kitchen table 23, it is preferred to mass-produce the items of hard material such as wood or plastic. The centerpiece, for example, preferably is a wooden bowl with several wooden apples in it, all in bright colors.

Figure 4:
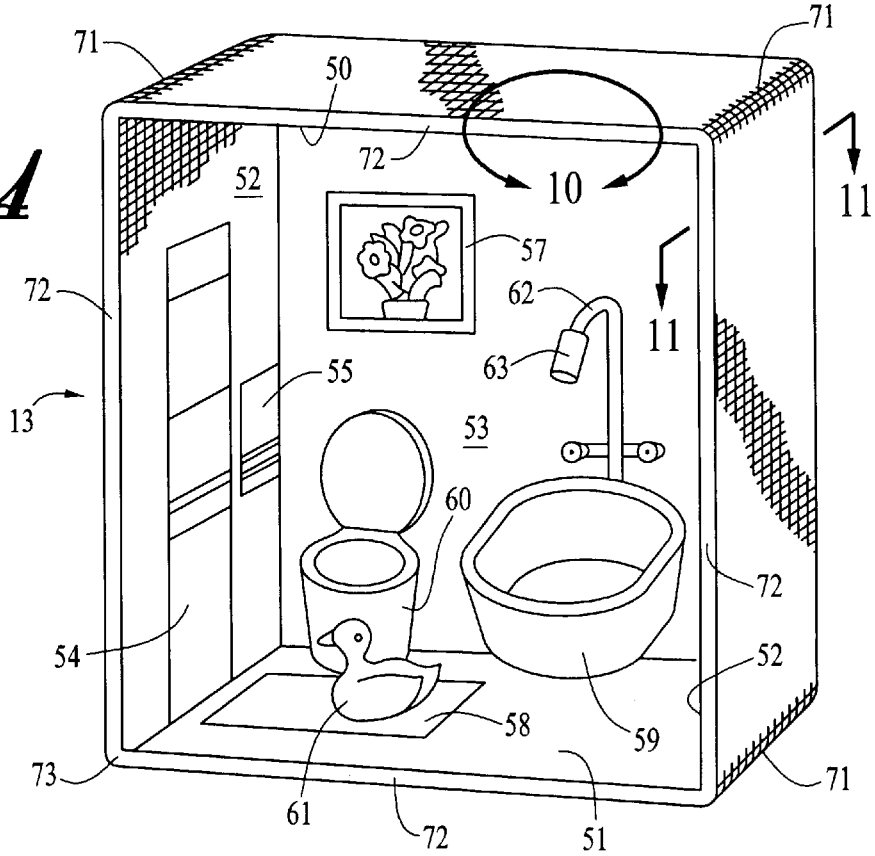
FIG. 4 is an enlarged front perspective view of another single room module shown in FIG. 1 and simulating a bathroom, also with parts in moved positions.
Figure 5:
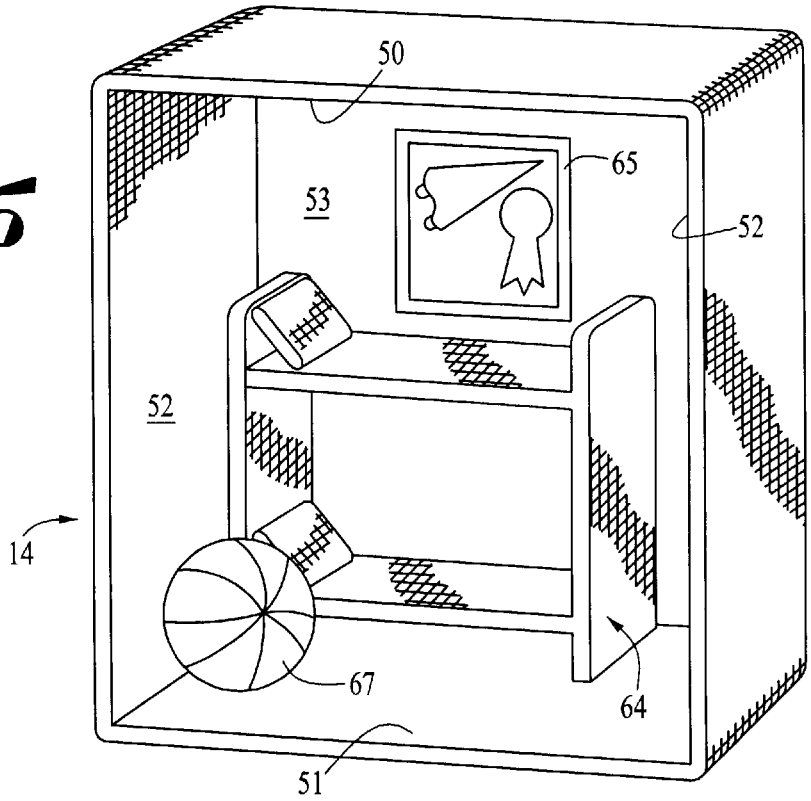
FIG. 5 is an enlarged front perspective view of another single room module shown in FIG. 1 and simulating a child's room, also with parts in moved positions.

Shown in FIGS. 4 and 5 are two smaller modules 13 and 14 which are decorated as a bathroom and a child's bedroom, respectively. These have shorter horizontal ceilings 50 and floors 51, upright end walls 52, and substantially square back or inside walls 53 opposite open square front sides of the same size as the back walls. These two modules can be of substantially the same in structure so as to be interchangeable, preferably having differing color schemes to offer a decorating choice.

It will be seen that most of the bathroom furnishings and accessories comprise felt cutouts in the form of a door 54, a towel 55, a picture 57 and a rug 58, and the three-dimensional furnishings comprise a bathtub 59, a stool 60 and a duck 61. The bathtub is composed of sewn felt strips and a "shower", the latter being an elongated internal armature wire (not shown) covered with a felt sleeve 62 and an enlarged felt shower head 63. The toy duck 61 completes the bathroom set, and preferably is composed of colored wood or plastic.

Similarly, the child's room accessories comprise a bunk bed 64, constructed in the same general manner as the chair 31 (FIG. 14), a felt cutout 65 simulating a picture, and a felt ball 67 referably comprising multi-colored felt segments that are sewn together and filled with batting or soft foam plastic (not shown).

FIGS. 10, 11 and 12 show the internal construction of the bathroom module 13 in FIG. 4, which is representative of all of the room modules 11 to 17 of the present invention. It can be seen in FIG. 4 that all of the external surfaces of the module 13 are covered with felt indicated generally herein by the number 70, in the form of strips or sheets cut to be coextensive with the outside surfaces of the substrate to be covered and to overhang the exposed edges of the substrate (see FIG. 10) and meet the felt strips covering the adjacent sides of the substrate. Where possible, the strips are joined by integral folds (for example, at the locations indicated at 71 in FIG. 4) and where necessary or desirable, are stitched or sewn to the free edges of adjacent strips. Examples of such sewing are on the exposed front edges 72 around the open side of the module and at 73 (FIG. 4), where the ends of the folded strip covering the outside of the module come together. For long term tightness, a coating of suitable glue is provided between the felt and the substrate before the felt is stitched in place.

As shown in FIGS. 11 and 12, the substrate for the module 13, which is representative of the structure of all of the modules, comprises stiff, flat panels, two 74 and 75 being shown in cross-section, that are butted together at the corners of the box-like module structure and securely fastened together, preferably by an adhesive 77 between the abutting surfaces. These adhesive joints are reinforced in the completed products by the felt coverings which enclose the substrate. The stitching along the edges at 72 (as in FIG. 10) produce a securely finished edge and an attractive appearance.

It is desirable for purposes of more realistic simulation of a conventional house exterior to provide a triangular shape for the module 15 that is shown as stacked on top of the larger two modules 11 and 12 in FIG. 1, to simulate the peak of the roof of the miniature house. This module comprises a rectangular base 78 forming the floor and two upwardly inclined sides 79 forming sloped ceilings of an attic room, joining at the peak. The base is the same size as the ceilings of the modules 11 and 12 so as to stack evenly on them in the full house shown in FIG. 1, or to stack on just one of them in the starter house shown in FIG. 2. The module is entirely covered in multi-colored felt 70, in the same manner as the other modules, so as to be held in stacked condition and to be decorated colorfully with wall, floor and exterior colors.

Furnishing accessories for the attic room are a bed 80 and a table 81, both constructed of external felt strips in the same manner used for the chair 31 in FIG. 14, and two-dimensional felt cut-outs shaped and printed to simulate a picture 82 and a rug 83 (FIG. 1). An alarm clock 84, which may be made of wood, is shown on the table in FIG. 1. The felt exteriors of the principal furnishings cooperate with the felt covering of the module 15 to hold the furnishings in selected positions while permitting re-arranging of the furnishings as desired during play.

When the smaller bathroom and child's room modules 13 and 14 are positioned against the ends of the kitchen module 11, convenient spaces for two deck- or porch-simulating modules 16 and 17 are provided on the second level at opposite ends of the living room module 12. These modules have a lower base 85 forming a floor or deck surface, and an upright side 87 forming a wall surface for engaging the end of the living room module 12. A triangular back piece 88 forms an inside wall having an edge 89 that is a continuation of the roof line formed by the triangular attic-simulating module 15.

Both of these deck modules 16 and 17 are covered with felt indicated generally at 70, as are the other modules, and both are provided with furnishing accessories appropriate for a deck or porch area. As shown most clearly in FIG. 9, these include two-dimensional felt cutouts printed to simulate a mirror 90, a planter 91, a flower pot 92 and butterflies 93, on one side, and a painting 94 on the other side, and three-dimensional felt figures stuffed with batting and simulating an easel 95 and a stack of books 97, which may be made of colored wood, if desired.

Figure 6:
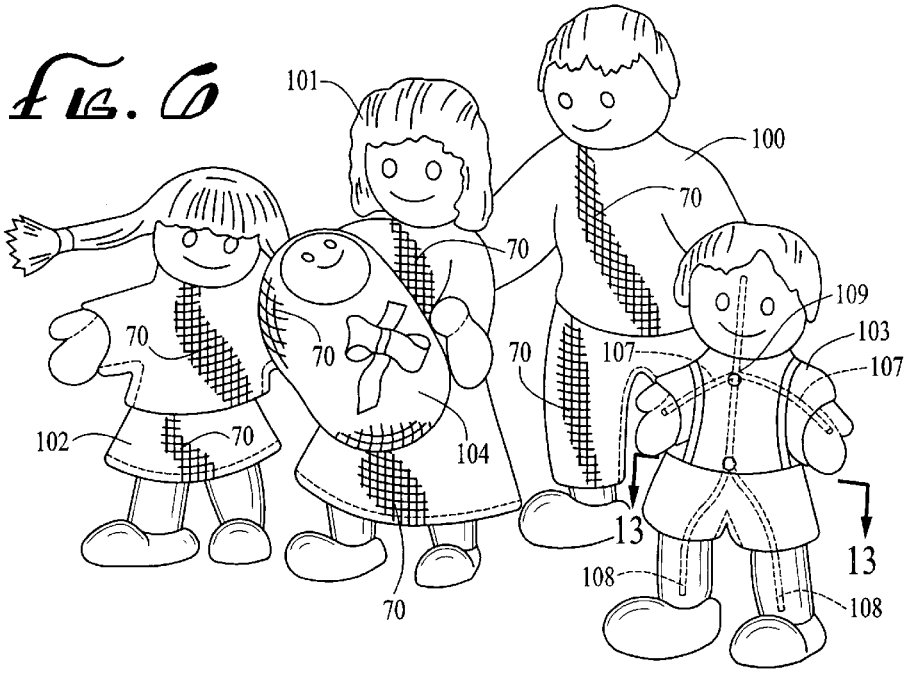
FIG. 6 is an enlarged perspective view of five dolls shown in different positions in FIG. 1, simulating a family of two adults and three children, one an infant.

When all of the modules described above are assembled in one miniature house, as shown, with corresponding sides open for access by a child during play, the entire household is accessible to the child, and furnishings can be moved around at will. For greater play value, a plurality of dolls also are provided, herein simulating an entire family of at least two adults 100 and 101 and three children 102, 103 and 104, the latter being an infant as shown in FIG. 6. An additional pair of adults 105 and 106 is shown in the living room module 12 in FIGS. 1 and 2.

These dolls are constructed with internal wire frames or armatures as indicated in broken lines in the doll 103 on the right in FIG. 6, the wires forming arms 107, legs 108 and a spine 109 and being bendable to permit flexing of the dolls. The external surfaces of the dolls are sewn felt, as indicated generally by the number 70, appropriately printed and colored in a primitive fashion to produce attractive but relatively inexpensive playthings. The felt coverings are filled with soft stuffing such as batting.

Figure 7:
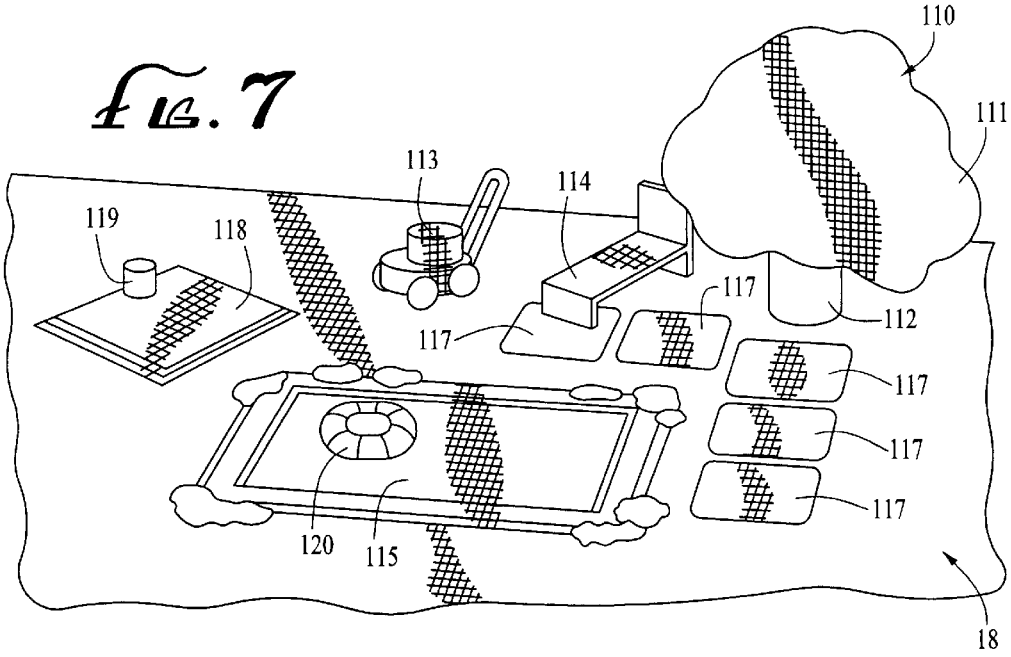
FIG. 7 is an enlarged fragmentary perspective view of a portion of the lawn-simulating piece shown in FIG. 1, together with several lawn furnishing accessories, also shown in moved positions.

Completing the miniature house toy 10 of the present invention is the lawn-simulating piece 18, herein a piece of green felt that may be printed to have the appearance of grass. Lawn furnishing accessories (FIGS. 1 and 7) include a simulated tree 110 with a green felt top 111 stuffed with batting and a trunk 112 stuffed with either batting or filler pellets (not shown), for weight, a felt-covered lawn mower 113, and a felt-covered chaise lounge 114, similar in construction to the chair 31 (FIG. 14). Two-dimensional printed felt cut-outs are provided to simulate a swimming pool 115, concrete patio blocks 117 and a sandbox 118, and additional outdoor play items may be provided, either in felt or in wood or plastic for small items, including a toy sandbox bucket 119 (FIG. 7) and a life preserver 120 (FIGS. 1 and 7).

Another set of furnishing accessories for the house toy 10 is in the form of simulated domestic animals, herein shown in FIG. 8 and including felt-covered dog-and-cat-simulating FIGS. 121 and 122, which are filled with suitable soft stuffing material such as batting or soft foam plastic, a felt-covered doghouse 123, of construction similar to the chair 31 in FIG. 14, and a simulated cat box 124, constructed of sewn felt and having a paperboard stiffener (not shown) sewn into its bottom side. Small accessories such as a dog bowl 125 and a cat bowl (not shown) may be made of wood or plastic, and animal play toys such as a dog ball 127 and a yarn ball 128 for the cat 122 are made of soft outside material and stuffed, the dog ball 127 preferably being felt-covered and filled with soft foam plastic and the yarn ball 128 preferably having a string-wound outside surface over a soft foam interior.

To avoid needless duplication, details of construction of representative components (the chair 31, the bathroom module 13, and the little boy 103 have ben provided, as applicable to the other components of the same general type, and lining for felt coverings and sheets have been generally indicated by the number 70 throughout the drawings, despite the fact that these items are intended to be of different colors and sizes to suit the circumstances of each component. The term "felt" has been used in its conventional meanings, without regard to the particular fiber or fibers that are used to make the felt. For reasons of economy, synthetics of various kinds are preferred, and are well known in the industry.

From the foregoing, it will be apparent that the present invention provides a novel and interesting miniature house toy 10 that may be provided in various forms ranging from an entire set to single-room or special group modules, and which are very versatile and enjoyable as a child's toy, utilizing the felt surfaces of both the modules and the principal components for colorful decoration and for positioning (and re-positioning) of the components in the assembly. It also will be apparent that, while a preferred embodiment of the invention has been illustrated and described in detail, various modifications and changes may be made by those skilled in the art without departing from the spirit and scope of the invention.

I claim:

1. A modular house toy having, in combination:

a plurality of flat-sided, three-dimensional, modules that are shaped and sized to be stacked to simulate rooms in the structure of a toy house;

said modules having corresponding sides that are open, to be arranged to form an open side of the toy house for access to the interiors of the rooms;

said modules comprising stiff, flat substrate panels that are shaped and joined together to form simulated walls, ceilings and floors of a plurality of simulated rooms, and coverings for at least exterior surfaces of said substrate panels and some interior surfaces thereof, said coverings being composed of felt and secured to said panels as permanent components of the modules, whereby the coverings for the exterior surfaces serve to position the modules in the stacked structure; and a plurality of toy furnishing accessories sized and shaped to be inserted in and to furnish interiors of said modules, said furnishing accessories having felt exterior surfaces for adhering to felt coverings for interior surfaces of said panels, thereby to position the furnishing accessories in the modules.

2. A modular house toy as defined in claim 1 wherein some of said modules are in the form of open-sided boxes having open rectangular sides for simulating rooms of different sizes, at least one of said room modules is in the form of an open-sided box having a triangular open side for simulating an attic room and a roof peak, and at least one of said modules is formed with more than one open side for simulating an open exterior space.

3. A modular house toy as defined in claim 1 wherein at least one of said modules is in the form of an open-sided box having a triangular open side, for simulating an attic room and a roof peak.

4. A modular house toy as defined in claim 1 wherein at least one of said modules is formed with more than one open side, for simulating open exterior space.

5. A modular house toy as defined in claim 1 further including a lawn-simulating set comprising a sheet of felt material to be laid beside said toy house, and lawn furnishing accessories having felt surfaces for engagement with said sheet of felt thereby to be held in selected positions beside the toy house and to be capable of being moved to different positions.

6. A modular house toy as defined in claim 1 further including at least one doll that is sized and shaped to simulate a person for occupying the toy house, said doll having exterior surfaces composed of felt for positioning the doll against felt surfaces of the modules.

7. A modular house toy as defined in claim 6 wherein said doll comprises an internal wire armature, an external covering composed at least partially of felt, and soft stuffing filling the external covering around the armature.

8. A modular house toy as defined in claim 7 wherein there are a plurality of such dolls for simulating a toy family occupying the toy house.

9. A modular house toy as defined in claim 1 wherein said panels are composed of wood and adhesively joined together at corners of said modules.

10. A modular house toy as defined in claim 1 wherein said felt coverings are layers of felt material overlaid on said substrate panels and sewn together along edges of the panels.

11. A modular house toy having, in combination:

a plurality of flat-sided, three-dimensional, modules that are shaped and sized to be stacked to simulate rooms in the structure of a toy house;

said modules having corresponding sides that are open, to be arranged to form an open side of the toy house for access to the interiors of the rooms; and said modules comprising stiff, flat substrate panels that are shaped and joined together to form simulated walls, ceilings and floors of a plurality of simulated rooms, and coverings for at least exterior surfaces of said substrate panels and some interior surfaces thereof, said coverings being composed of felt and secured to said panels as permanent components of the modules, and being stackable with the felt coverings in contact with each other without any intervening connectors, whereby the coverings for the exterior surfaces serve to position the modules in the stacked structure.

12. A modular house toy as defined in claim 11 further including a plurality of toy furnishing accessories sized and shaped to be inserted in and to furnish interiors of said modules, said furnishing accessories having felt exterior surfaces for adhering to felt coverings for interior surfaces of said panels, thereby to position the furnishing accessories in the modules.

13. A modular house toy as defined in claim 11 wherein some of said modules are in the form of open-sided boxes having open rectangular sides for simulating rooms of different sizes, at least one of said room modules is in the form of an open-sided box having a triangular open side for simulating an attic room and a roof peak and at least one of said modules is formed with more than one open side for simulating an open exterior space.

14. A modular house toy as defined in claim 11 wherein said panels are composed of wood and adhesively joined together at corners of said modules.

15. A modular house toy as defined in claim 11 further including at least one doll sized and shaped to simulate a person for occupying the toy house, said doll having exterior surfaces composed of felt for positioning the doll against felt surfaces of the modules.

16. A modular house toy as defined in claim 15 wherein said doll comprises an internal wire armature, an external covering composed at least partially of felt, and batting filling the external covering around the armature.

17. A modular house toy as defined in claim 16 wherein there are a plurality of such dolls for simulating a toy family occupying the toy house.

18. For use in a modular house toy with furnishing accessories having felt surfaces, a flat-sided, three dimensional module for simulating a room in a modular toy house, comprising:

a plurality of stiff, flat substrate panels that are shaped and joined together to form simulated walls and floor of a simulated room that is open on one side for access to the interior of the module;

felt coverings secured to exterior surfaces of said module for positioning the module against other room modules having felt exterior surfaces; and additional felt coverings secured to interior surfaces of said module for simulating interior decoration of the simulated room and for engaging the felt surfaces of the furnishing accessories to position the same in the simulated room.

19. A module as defined in claim 18 in the form of an open-sided box having a rectangular open side for simulating a room having a floor, a ceiling and three upright walls.

20. A module as defined in claim 18 in the form of an open-sided box having a triangular open side for simulating an attic room and a roof peak.

21. A module as defined in claim 18 further including a plurality of toy furnishing accessories sized and shaped to be inserted in and to furnish the interior of the simulated room, said furnishing accessories having felt exterior surfaces for adhering to the felt coverings on said interior surfaces.

22. A module as defined in claim 21 further including at least one doll that is sized and shaped to simulate a person for occupying the simulated room, said doll having exterior surfaces composed of felt for positioning the doll against the felt coverings secured to said interior surfaces.

23. A module as defined in claim 18 wherein said panels are composed of wood and adhesively joined together at the comers of said module.

24. A module as defined in claim 23 wherein said coverings are layers of felt material overlaid on said panels and sewn together along edges of the panels.

* * * * *